US008022363B2

(12) United States Patent
Iwamoto et al.

(10) Patent No.: US 8,022,363 B2
(45) Date of Patent: Sep. 20, 2011

(54) ION TRAP MASS SPECTROMETER

(75) Inventors: Shinichi Iwamoto, Kyoto (JP); Kei Kodera, Kyoto (JP); Sadanori Sekiya, Kusatsu (JP)

(73) Assignee: Shimadzu Corporation, Kyoto (JP)

( * ) Notice: Subject to any disclaimer, the term of this patent is extended or adjusted under 35 U.S.C. 154(b) by 153 days.

(21) Appl. No.: 12/595,393

(22) PCT Filed: Mar. 28, 2008

(86) PCT No.: PCT/JP2008/000811
§ 371 (c)(1),
(2), (4) Date: Nov. 11, 2009

(87) PCT Pub. No.: WO2008/129850
PCT Pub. Date: Oct. 30, 2008

(65) Prior Publication Data

US 2010/0065740 A1 Mar. 18, 2010

(30) Foreign Application Priority Data

Apr. 12, 2007 (JP) ..... 2007-104624

(51) Int. Cl.
*H01J 49/42* (2006.01)
*H01J 3/00* (2006.01)

(52) U.S. Cl. ..... 250/292; 250/282; 250/281; 250/293; 250/423 R

(58) Field of Classification Search ..... 250/292, 250/282, 281, 293, 423 R
See application file for complete search history.

(56) References Cited

U.S. PATENT DOCUMENTS 5,397,894 A 3/1995 Wells et al.
6,121,610 A 9/2000 Yoshinari et al.
(Continued)

FOREIGN PATENT DOCUMENTS

JP 04-138650 A 5/1992
(Continued)

OTHER PUBLICATIONS

Osamu Furuhashi, et al. "Development Digital Ion Trap Mass Spectrometer", Shimadzu Review: Shimadzu Hyoron Hensyubu, Mar. 2006, pp. 141-151, vol. 62, Nos. 3•4.
(Continued)

*Primary Examiner* — Nikita Wells
(74) *Attorney, Agent, or Firm* — Sughrue Mion, PLLC

(57) ABSTRACT

While applying a square wave voltage to the ion electrode (21) so that ions already captured in the ion trap (20) do not disperse, the frequency of the square wave voltage is temporarily increased at the timing when the ions generated in response to the short time irradiation of a laser light reach the ion inlet (25). This decreases the Mathieu parameter $q_z$, and the potential well becomes shallow, which makes it easy for ions to enter the ion trap (20). Although the ions that have been already captured become more likely to disperse, the frequency of the square wave voltage is decreased before they deviate from the stable orbit. Thus, the dispersion of the ions can also be avoided. Accordingly, while the number of captured ions is not decreased, new ions are further added, and thereby the amount of ions can be increased. By performing a mass separation and detection after that, the signal intensity in one mass analysis can be increased. Thereby, the number of repetition of the mass analysis for summing up the mass profiles can be decreased, and the signal intensity can be increased while decreasing the measuring time.

15 Claims, 9 Drawing Sheets

U.S. PATENT DOCUMENTS

| | | | | |
|---|---|---|---|---|
| 6,900,433 | B2 | 5/2005 | Ding | |
| 2008/0302958 | A1* | 12/2008 | Green | 250/282 |
| 2009/0114810 | A1* | 5/2009 | Green | 250/282 |
| 2010/0116982 | A1* | 5/2010 | Iwamoto et al. | 250/292 |

FOREIGN PATENT DOCUMENTS

| | | | |
|---|---|---|---|
| JP | 07-085836 | A | 3/1995 |
| JP | 11-120956 | A | 4/1999 |
| JP | 2003-016991 | A | 1/2003 |
| JP | 3386048 | B2 | 3/2003 |
| WO | 95/019041 | A1 | 7/1995 |

OTHER PUBLICATIONS

Form PCT/IB/373 (English): Translation of International Preliminary Report on Patentability for International application No. PCT/JP2008/000811 filed Mar. 28, 2008, Oct. 13, 2009.

Form PCT/IB/373 (Japanese): International Preliminary Report on Patentability for International application No. PCT/JP2008/000811 filed Mar. 28, 2008, Oct. 13, 2009.

* cited by examiner (a) NO ADDITIONAL ION INJECTION (b) ONE ADDITIONAL ION INJECTION (c) TWO ADDITIONAL ION INJECTIONS (a) MASS SPECTRUM BY THE APPARATUS OF THE PRESENT EMBODIMENT (b) MASS SPECTRUM OF THE SAMPLE FOR MASS CALIBRATION (PEG)

(c) MS/MS SPECTRUM OF m/z=1880 OF THE SAMPLE TO BE ANALYZED (a) MASS ERROR AFTER THE MASS CALIBRATION BY THE EXTERNAL STANDARD METHOD (b) MASS ERROR AFTER THE MASS CALIBRATION BY THE PRESENT EMBODIMENT (INTERNAL STANDARD METHOD)

ION TRAP MASS SPECTROMETER

TECHNICAL FIELD

The present invention pertains to an ion trap mass spectrometer having an ion trap for trapping ions by an electric field.

BACKGROUND ART

One conventionally known type of mass spectrometer uses an ion trap for capturing (or trapping) ions by an electric field. A typical ion trap is a so-called three-dimensional quadrupole ion trap, which has a substantially-circular ring electrode and a pair of end cap electrodes placed to face each other across the ring electrode. In such an ion trap, conventionally, a sinusoidal radio-frequency voltage is applied to the ring electrode to form a capture electric field, and ions are oscillated and trapped by this capture electric field. In recent years, the digital ion trap (DIT) for trapping ions by applying a square wave voltage in place of a sinusoidal voltage has been developed (refer to Non-Patent Document 1 and other documents).

In the case where the sample is biological, a laser desorption ionization (LDI) source such as the matrix assisted laser desorption ionization (MALDI) source is often used as an ion source for generating ions to be trapped in the ion trap as previously described.

In an ion trap mass spectrometer in which the MALDI and the DIT are combined, a pulse of laser light is delivered to a sample, and ions generated thereby from the sample are injected into the ion trap. In this process, in order to increase the ion capture efficiency, an inert gas is introduced inside the ion trap in advance to make the entering ions collide with the inert gas to decrease the kinetic energy of the ions. This operation is called a cooling. After stably capturing the ions inside the ion trap in this manner, an ion or ions having a specific mass-to-charge ratio (m/z) are excited and ejected from the ion trap to be detected by a detector. A mass scan is performed by scanning the mass-to-charge ratio of the excited ion, and a mass spectrum is created based on the detection signal obtained through scanning.

In a general MALDI, a single pulse of laser light irradiation often fails to generate a sufficient amount of ions, and in such a case, the signal-to-noise ratio (S/N) of the mass spectrum data obtained by one mass analysis as described above is low. Given this factor, in conventional apparatuses, a mass spectrum data with a high S/N is obtained by the following manner: ions are generated by a shot of laser light irradiation; the ions are injected into the ion trap; the ions are cooled (and captured); and mass separation and detection of the ions are performed, where these processes are repeated for a predetermined number of times (ten times, for example), and the mass profiles obtained from each process are summed up on a computer.

The more the number of repetitions of the series of processes is increased, the more the S/N of the mass spectrum data is improved. However, this causes a problem in that the measuring time to obtain a measurement result, i.e. a final mass spectrum, is elongated. For example, the apparatus that the inventors of the present application used for the experiment requires a measuring time of about 1.1 seconds for one process. Therefore, about 11 seconds are required for a total of ten times, and about 33 seconds for a total of thirty times. Accordingly, the throughput of analysis decreases and the cost of analysis increases.

[Non-Patent Document 1] Furuhashi, Takeshita, Ogawa, and Iwamoto, et al. "Digital Ion Trap Mass Spectrometer no Kaihatsu," *Shimadzu Review*: Shimadzu Hyoron Hensyubu, Mar. 31, 2006, vol. 62, nos. 3·4, pp. 141-151.

DISCLOSURE OF THE INVENTION

Problem to be solved by the Invention

The present invention is accomplished to solve the aforementioned problem, and the main objective thereof is to provide an ion trap mass spectrometer that can decrease the measuring time for obtaining the measurement data with the quality (e.g. S/N) as high as before and contributes to improve the throughput of analysis and to reduce the cost.

Means for Solving the Problem

To solve the previously described problem, the present invention provides an ion trap mass spectrometer having an ion source for supplying pulsed ions and an ion trap for capturing the ions by an electric field formed in a space surrounded by a plurality of electrodes, wherein ions supplied from the ion source are injected into and captured in the ion trap, and a mass analysis is performed by the ion trap or a mass analysis is performed after the ions are ejected from the ion trap, the ion trap mass spectrometer including:

a) a voltage applier for applying an alternating-current voltage (AC voltage) for capturing ions in the ion trap to at least one of the plurality of electrodes which compose the ion trap; and b) a controller for controlling the voltage applier in such manner that, while the AC voltage is applied to one of the plurality of electrodes to capture ions in the ion trap, the AC voltage temporarily changes when ions supplied in a pulsed fashion from the ion source reaches an ion inlet of the ion trap, wherein, while the ions are captured in the ion trap, ions supplied from the ion source are additionally injected into the ion trap.

As an embodiment of the ion trap mass spectrometer according to the present invention, the controller may control the voltage applier in such a manner as to temporarily increase the frequency of the AC voltage with the amplitude thereof kept constant.

As another embodiment of the ion trap mass spectrometer according to the present invention, the controller may control the voltage applier in such a manner as to temporarily decrease the amplitude of the AC voltage with the frequency thereof kept constant.

If the frequency of the AC voltage is increased or the amplitude thereof is decreased as previously described, the potential well in the ion trap becomes shallow, and the ions entering the ion trap from outside become less likely to be affected by the phase of the AC voltage. That is, the ions become more likely to be injected into the ion trap regardless of the phase of the AC voltage. In this process, however, since the containing force on the ions that have been captured immediately before in the ion trap weakens, the ions existing in the ion trap gradually disperse. Considering this factor, the period to change the AC voltage is set to be as short as possible to suppress the decrease in the amount of ions due to such a dispersion to substantially zero or small. This minimizes the decrease in the amount of the ions previously captured in the ion trap, while ions are newly injected from outside, so that the amount of ions increase in the ion trap. In such a manner, a mass analysis can be performed after the amount of ions captured in the ion trap is increased.

In the series of processes of a mass analysis as previously described, the time required for generating ions and injecting ions into the ion trap is short; compared to this, the time required for a cooling and mass separation and detection is long. In particular, in performing a mass analysis (mass separation) in an ion trap, the time required for mass separation and detection is dominant in the measuring time. Therefore, by repeating the supply of ions and the injection of ions into the ion trap as previously described a plurality of times and then performing the mass separation and detection, the signal intensity can be increased without substantially increasing the measuring time of one process.

The traveling time of an ion from the time point when the ion is generated in, or the ion is ejected from, the ion source until the ion reaches the inlet of the ion trap depends on the distance between the ion source and the ion trap, the intensity of the electric field between them, and other factors. In addition, since an ion with smaller mass travels faster in the same electric field, the traveling time of ions depends also on their mass. Therefore, the controller may preferably control the ion source in such a manner that the AC voltage is changed (for a predetermined period) at the time point when the traveling time of ions has elapsed after the ions were delivered in a pulsed fashion from the ion source.

In the ion trap mass spectrometer according to the present invention, the AC voltage that is applied to at least one of the electrodes composing the ion trap may preferably be a square wave voltage. This is a so-called digital ion trap. With a digital ion trap, the change in the frequency or amplitude of the AC voltage (square wave voltage) can be performed in a very short time, and therefore the ions that have arrived at the ion inlet can be efficiently injected into the ion trap and it is also possible to suppress the dispersion of ions that had been captured before then.

As an embodiment of the ion trap mass spectrometer according to the present invention, the ion source may be a laser ion source for delivering a pulsed laser light to a sample to ionize the sample or a component of the sample. For example, the ion source may be a matrix assisted laser desorption ionization (MALDI) source. With this configuration, since the timing of generating ions is determined by the timing of a laser light irradiation, the controller has only to change the AC voltage, with reference to the position (or time point) of the generation of a laser drive pulse, after a predetermined time has elapsed from the position. Hence, the control of the timing is facilitated.

As another embodiment of the ion trap mass spectrometer according to the present invention, the ion source may include an ion holding unit for temporarily holding ions originating from a sample using an electric field or magnetic field, compressing them, and then ejecting them in a pulsed fashion. As such an ion holding unit, the configuration disclosed in Japanese Patent No. 3386048 may be used. In this case, the source of ions (ionization apparatus) may use a variety of atmospheric pressure ionization methods such as, but not limited to: an electrospray ionization (ESI) method; atmospheric pressure chemical ionization (APCI) method; and atmospheric pressure chemical photo ionization (APPI) method.

In the ion trap mass spectrometer according to the present invention, the ion trap may be a linear ion trap, or more preferably it may be a three-dimensional quadrupole ion trap having a ring electrode and a pair of end cap electrodes.

In addition, the ion trap mass spectrometer according to the present invention may further include an ion transport means of an electrostatic lens for transporting ions supplied from the ion source to the ion trap. As the electrostatic lens, an Einzel lens (or unipotential lens) may be used, for example. Since the ion transport means of an electrostatic lens can suppress the spread in the traveling time of ions from the ion source to the ion trap caused by the difference in the mass of ions, ions in a broader mass range can be very efficiently injected into the ion trap.

The ion trap mass spectrometer according to the present invention may be constructed as follows. Ions are first captured in the ion trap, then the frequency or the amplitude of the AC voltage is changed to selectively eject ions having a specific mass-to-charge ratio from the ion trap, and the ejected ions are detected by a detector. Since, in general, the time required for mass separating and detecting ions is considerably long compared to that for generating ions and injecting them into the ion trap, the effect of reducing the measuring time is considerably large in the present invention where ions are mass analyzed by the ion trap itself.

The ion trap mass spectrometer according to the present invention may be constructed as follow. Ions are first captured in the ion trap, then the captured ions are collectively ejected from the ion trap, and the ejected ions are injected into a mass analyzer to be mass analyzed and then detected by a detector. As the mass analyzer and detector, a time-of-flight mass spectrometer can be used, for example.

In the ion trap mass spectrometer according to the present invention, ions originating from the same sample are not additionally injected into the ion trap, but ions originating from different samples can be added to the ion trap efficiently. That is, ions originating from different samples can be mixed in the ion trap. Using this method, a mass calibration by an internal reference method, which is efficient for enhancing the precision of mass data in a mass analysis, can be realized.

As an embodiment for performing a mass calibration, the ion trap mass spectrometer according to the present invention may be constructed as follows. The ion source selectively supplies an ion originating from a sample to be analyzed ("analysis sample") and an ion originating from a sample for mass calibration ("calibration sample"), and the ion trap mass spectrometer further includes:

an analysis controller for supplying either one of ions originating from the analysis sample and ions originating from the calibration sample from the ion source, and, while the ions are captured in the ion trap, for supplying the other one of the ions originating from the analysis sample and the ions originating from the calibration sample from the ion source and additionally injecting the ions into the ion trap, and then mass analyzing the mixture of the ions originating from the analysis sample and the ions originating from the calibration sample in the ion trap or mass analyzing them after ejecting them from the ion trap; and a data processor for performing a mass calibration by using the data of the ions originating from the calibration sample in the mass spectrum data obtained under the control of the analysis controller.

In the ion trap mass spectrometer according to this embodiment, ions originating from the analysis sample are first supplied by the ion source, for example, and these ions are stably captured in the ion trap. Then, ions originating from the calibration sample are supplied from the ion source, and while minimizing the loss of the previously captured ions, as described before, ions originating from the calibration sample are additionally injected into the ion trap. Since the injection of the additional ions are efficiently performed, a sufficient amount of both the ions originating from the analysis sample and the ions originating from the calibration sample can be captured in the ion trap. If the amount of ions in one ion injection process is insufficient, ions of the same kind can be additionally injected into the ion trap in the same manner. By mass analyzing the ions mixed in the ion trap in such a manner, a mass spectrum in which the peaks of both ions appear can be obtained, and the data processor can perform an accurate mass calibration by the internal reference method.

In this case, in the ion source, the generation of ions originating from the analysis sample and the generation of ions originating from the calibration sample can be performed at different timings. In other words, because they are not generated simultaneously, it is not necessary to ionize a mixed sample of the analysis sample and the calibration sample, so that the ionization conditions can be independently set.

In particular, the ion source may include, for example:

a sample plate for holding the analysis sample and the calibration sample in different positions;

a laser light irradiator for delivering a pulsed laser light to a sample to ionize a component in the sample; and a moving means for moving the sample plate in such a manner as to selectively position the analysis sample or the calibration sample at a position where the laser light is delivered by the laser light irradiator. This includes a matrix assisted laser desorption ionization source.

In an ordinary internal reference method, a mixed sample of an analysis sample and a calibration sample must be prepared. On the other hand, in the method according to the aforementioned embodiment, an analysis sample and a calibration sample can be independently prepared, which alleviates the sample preparation work nearly to the external standard method. Furthermore, since the optimum solvent and matrix can be selected in accordance with each sample, the sample preparation work is also simplified in this respect, and the amount of generated ions can be increased. Moreover, since the ionizations of both samples are performed at different timings, it is also free from the problem of "ionization competition" in which ionization of a sample is suppressed when ionization of the other sample is dominant. This facilitates and simplifies the sample preparation, and furthermore, the ionization of each sample can be performed well, i.e. with high efficiency.

Since the ionization conditions other than the sample itself can be optimized for each sample, the laser light irradiator may change the intensity of the laser light between the case for ionizing the analysis sample and the case for ionizing the calibration sample.

The ion trap mass spectrometer according to the aforementioned embodiment can also be applied to an MS/MS analysis or an $MS^n$ analysis in which ions generated from the analysis sample are not directly mass analyzed but such ions are dissociated one or plural times and the product ions generated thereby are mass analyzed.

That is, the ion trap mass spectrometer according to the aforementioned embodiment may further include:

an ion selector for applying a voltage to at least one of the plurality of electrodes which compose the ion trap in such a manner as to leave ions having a specific mass and remove the other ions from the ion trap among ions captured in the ion trap; and a dissociation promoter for promoting the dissociation of ions captured in the ion trap, and ions originating from the analysis sample are first captured in the ion trap, and ions having the specific mass are left in the ion trap by the ion selector, then a dissociation of the left ions is promoted by the dissociation promoter, and after that, the ions originating from the calibration sample is additionally injected into the ion trap.

Alternatively, the ion trap mass spectrometer according to the aforementioned embodiment may further include an ion selector for applying a voltage to at least one of the plurality of electrodes which compose the ion trap in such a manner as to leave ions having a specific mass and remove the other ions from the ion trap among ions captured in the ion trap, and, ions originating from the analysis sample are first captured in the ion trap, and ions having the specific mass is left in the ion trap by the ion selector, and then ions originating from the calibration sample are additionally injected into the ion trap.

With such configurations, the mass of the ion peaks appearing on the mass spectrum obtained by an MS/MS analysis or $MS^n$ analysis can also be accurately computed under the mass calibration by the internal reference method.

Effects of the Invention

In the ion trap mass spectrometer according to the present invention, while ions are captured in the ion trap, ions newly generated can further be added and injected into the ion trap. Therefore, the mass separation and detection can be performed after increasing the amount of the ions captured in the ion trap, and the target ion can be detected with higher signal intensity than before. Hence, a mass spectrum with a sufficiently high S/N can be created without repeating the mass analysis and summing up the results, or with less number of repetitions of such mass analysis and summing up. In addition, the measuring time required for the creation of a mass spectrum with a comparable S/N can be significantly reduced than ever before. Hence, the throughput of an analysis can be improved, and simultaneously the cost required for an analysis of one sample can be reduced.

As previously described, ions having different masses reach the ion inlet at different times even though they simultaneously depart from the ion source. Therefore, if the width of time during which ions can enter the ion trap is short, the range of mass of ions that can be injected becomes narrow. On the other hand, in the ion trap mass spectrometer according to the present invention, the time width during which ions can enter can be made relatively large. For example, according to the simulation computation performed by the inventors of the present patent application, which will be described later, even if this time width is set to as large as approximately 30 [μs], the amount of already captured ions hardly decreases. The time width of 30 [μs] is equivalent to fifteen cycles of the AC voltage at frequency 500 [kHz]. This is a considerably large period, and is effective to additionally inject ions of sufficiently large mass range into the ion trap.

In the embodiment in which the ion trap mass spectrometer according to the present invention is used for a mass calibration, the mass accuracy as high as an internal reference method can be achieved, while the troublesome sample preparation work and the problems in an ion generation associated with a general internal reference method are avoided. In addition, a mass calibration substantially as accurate as the internal reference method can be performed not only in a general mass analysis, but also in an MS/MS analysis or $MS^n$ analysis.

EXPLANATION OF NUMERALS

1 . . . Sample Plate
2 . . . Sample
2A . . . Analysis sample
2B . . . Calibration sample
3 . . . Laser Irradiator
4 . . . Mirror
13 . . . Aperture
14 . . . Einzel Lens
20 . . . Ion Trap
21 . . . Ring Electrode
22 . . . Entrance-Side End Cap Electrode
23 . . . Exit-Side End Cap Electrode
24 . . . Capture Region
25 . . . Ion Inlet
26 . . . Ion Outlet
27 . . . Entrance-Side Electric Field Correction Electrode
28 . . . Draw Electrode
29 . . . Cooling Gas Supplier
30 . . . Ion Detector
31 . . . Conversion Dynode
32 . . . Secondary Electron Multiplier
40 . . . Control Unit
42 . . . Capture Voltage Generator
43 . . . Auxiliary Voltage Generator
44 . . . Data Processing Unit
51 . . . Sample Stage
52 . . . Sample Stage Drive
53 . . . CID Gas Supplier

BEST MODES FOR CARRYING OUT THE INVENTION

Figure 4:
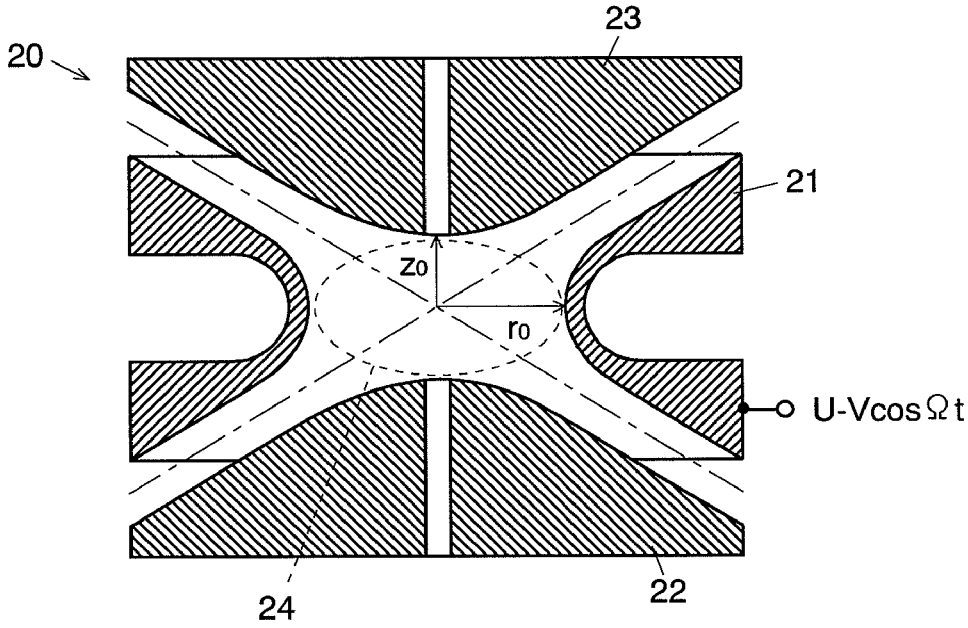
FIG. 4 is a diagram illustrating the basic configuration of a three-dimensional quadrupole ion trap.

First, the principle of the additional ion injection in the ion trap mass spectrometer is described. We consider a typical three-dimensional quadrupole ion trap in the cylindrical coordinate system (r, Z) as illustrated in FIG. 4. That is, the ion trap 20 is composed of a circular ring electrode 21 and a pair of end cap electrodes 22 and 23 opposing each other with the ring electrode 21 therebetween. The inner surface of the ring electrode 21 has the shape of a hyperboloid-of-one-sheet-of-revolution, and that of the end cap electrodes 22 and 23 has the shape of a hyperboloid-of-two-sheets-of-revolution. The space surrounded by the electrodes 21, 22, and 23 forms a capture region 24. As illustrated, we consider the case where a voltage of U−V cos Ωt as a radio-frequency (RF) voltage for capture (which will be simply called "RF voltage" hereinafter) is applied to the ring electrode 21.

The motion of a variety of ions in the quadrupole electric field formed in the capture region 24 when the RF voltage is applied can be described by the following independent motion equations (1) and (2) respectively for the Z direction and r direction.

$$d^2r/dt^2+(z/mr_0^2)(U-V\cos\Omega t)r=0 \quad (1)$$

$$d^2Z/dt^2+(2z/mr_0^2)(U-V\cos\Omega t)Z=0 \quad (2)$$

where m is the mass of an ion, z is the electric charge of the ion, and $r_0$ is the inscribed radius of the ring electrode 21. Defining $a_z$, $a_r$, $q_z$, and $q_r$ by the equations (3) and (4):

$$a_z=-2a_r=-8U/[(m/z)r_0^2\,\Omega^2] \quad (3)$$

$$q_z=-2q_r=4V/[(m/z)r_0^2\,\Omega_2] \quad (4),$$

then the motion equations (1) and (2) can be expressed in the form of the Mathieu equations of the following expressions (5) and (6):

$$d^2r/d\zeta^2+(a_r-2q_r\cdot\cos 2\zeta)r=0 \quad (5)$$

$$d^2Z/d\zeta^2+(a_z-2q_z\cdot\cos 2\zeta)Z=0 \quad (6),$$

where $\zeta=(\Omega t)/2$.

Figure 5:
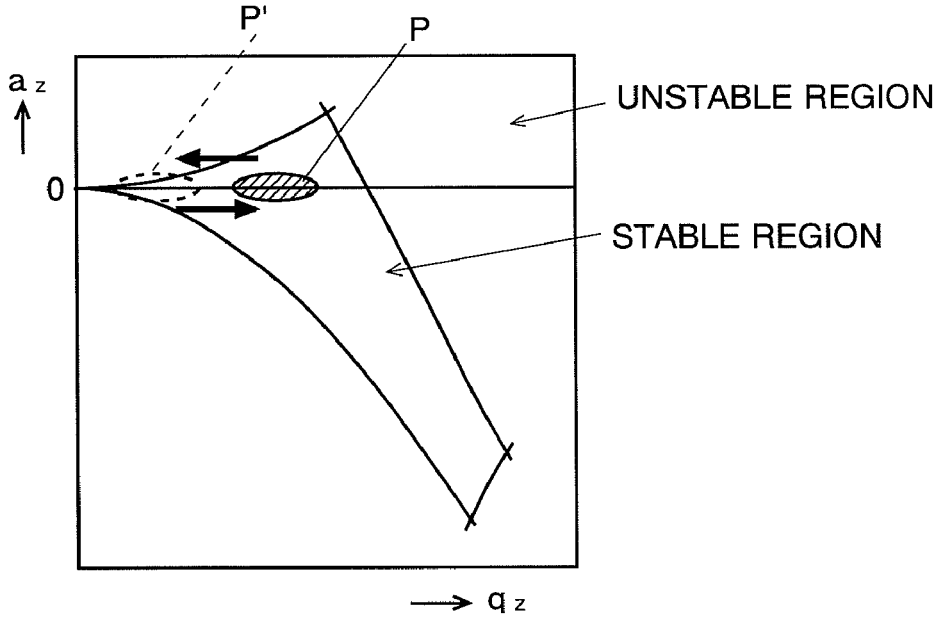
FIG. 5 is a diagram for explaining the stability conditions of the solutions of the Mathieu equations.

The property of the solutions of the Mathieu equation can be expressed using the Mathieu parameters $a_z$ and $q_z$. FIG. 5 is a diagram for explaining the stability conditions of the solutions of the Mathieu equation, where the vertical axis represents $a_r$ and the horizontal axis represents $a_z$. The region surrounded by solid lines in the $a_z$-$q_z$ plane illustrated in FIG. 5 corresponds to the stability solutions of the equation. That is, the Mathieu parameters $a_z$ and $q_z$ are determined by the mass-to-charge ratio m/z of ion, and in the case where the pair ($a_z$,$q_z$) of these values exist in a specific area, the ion keeps oscillating at a specific frequency and captured in the capture region 24. In particular, the stable region surrounded by solid lines in FIG. 5 is the area in which an ion can stably exist in the capture region 24, and the outside thereof is the unstable region in which the ion disperses.

In the case of a digital ion trap, a square wave voltage is applied in place of the RF voltage, and it is well known that basically the above-described relationship can be used as well (refer to the aforementioned Non-Patent Document 1). In this case, given that the low level voltage of the square wave voltage is V2, the high level voltage thereof is V1, and the duty ratio thereof is 0.5, $$V=(1/2)(V1-V2) \quad (7)$$

$$U=(1/2)V1+(1/2)V2 \quad (8).$$

That is, V is the amplitude of the square wave voltage. The equation (4) indicates that the Mathieu parameter $q_z$ is proportional to the amplitude of the square wave voltage and inversely proportional to the frequency. Therefore, if the frequency is increased or the amplitude is decreased, the Mathieu parameter $q_z$ becomes smaller.

The depth of the pseudo-potential well formed by the quadrupole electric field in the capture region 24 is $$(\pi^2/48)\cdot V\cdot q_z \quad (9).$$

Therefore, as the Mathieu parameter $q_z$ becomes smaller, the potential well becomes shallower.

The ions stably captured in the capture region 24 in the ion trap 20 are at a position near the center of the stable region, as indicated by P in FIG. 5, for example. If the frequency of the square wave voltage applied to the ring electrode 21 is increased or the amplitude thereof is decreased from this state, the Mathieu parameter $q_z$ becomes small, and the potential well of the capture region 24 becomes shallow. If the potential well is shallow, ions entering the ion trap 20 from the outside become less likely to be affected by the phase of the radio-frequency electric field, whereby the ions are easy to enter the ion trap 20 regardless of the phase of the radio-frequency electric field. This facilitates additionally injecting new ions into the ion trap 20 while a square wave voltage is applied to the ring electrode 21.

As the Mathieu parameter $q_z$ becomes smaller, however, the position of the ions moves from P to P' in FIG. 5, for example. That is, since they come closer to the boundary of the stable region, and a part of them enter the unstable region, the containing force to the ions already captured in the capture region 24 becomes weak, and the ions gradually disperse toward the periphery. Considering that, the period of decreasing the Mathieu parameter $q_z$ is limited to a short time, and thereby $q_z$ is returned to the original high value before the ions captured in the capture region 24 deviate from the stable orbit to be b eliminated. Thus ions in a packeted form are newly added to the capture region 24 without decreasing the amount of ions in the capture region 24.

EMBODIMENTS

First Embodiment

Figure 1:
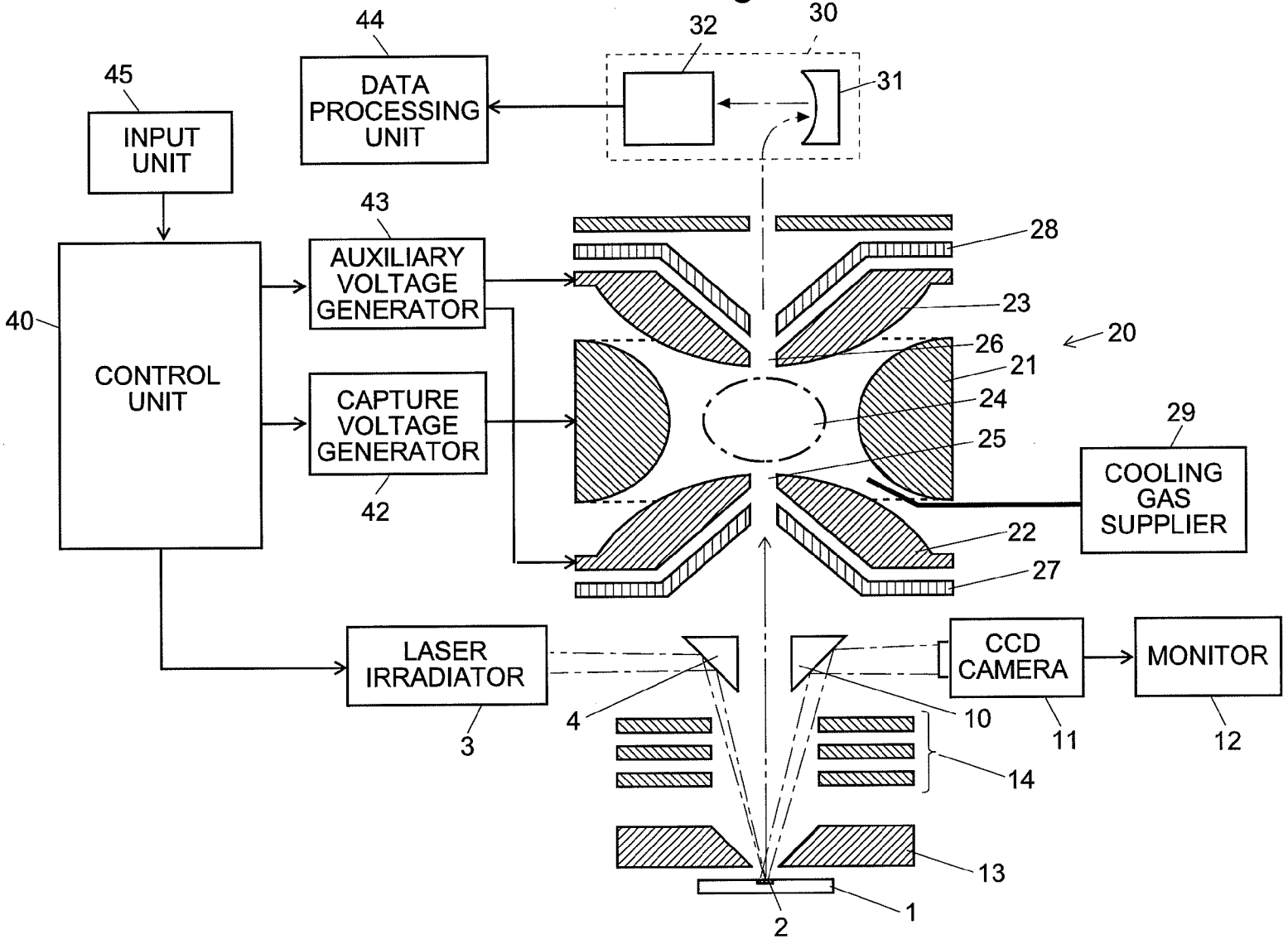
FIG. 1 is an entire configuration diagram of the MALDI-DIT-MS according to the first embodiment of the present invention.

The configuration and operation of the matrix assisted laser desorption ionization digital ion trap mass spectrometer (MALDI-DIT-MS) which is an embodiment (the first embodiment) of the present invention will be described in detail. FIG. 1 is an entire configuration diagram of the MALDI-DIT-MS according to this embodiment.

The ion trap 20 is the previously-described three-dimensional quadrupole ion trap which is composed of a circular ring electrode 21 and a pair of end cap electrodes 22 and 23 opposing (high and low in FIG. 1) each other with the ring electrode 21 therebetween. An ion inlet 25 is bored through the substantially center of an entrance-side end cap electrode 22. Outside of the ion inlet 25, an entrance-side electric field correction electrode 27 is placed for correcting the disorder of the electric field around the ion inlet 25. At substantially center of the exit-side end cap electrode 23, an ion outlet 26 is bored substantially in alignment with the ion inlet 25. Outside of the ion outlet 26, a draw electrode 28 is placed for drawing ions toward an ion detector 30, which will be described later. A cooling gas supplier 29 is provided for supplying a cooling gas (usually, inert gas) for cooling ions in the ion trap 20 as will be described later.

A MALDI ion source (which corresponds to the ion source in the present invention) for generating ions includes: a laser irradiator 3 for emitting a laser light to be delivered to a sample 2 prepared on a sample plate 1; and a mirror 4 for reflecting and focusing the laser light on the sample 2. An observation image of the sample 2 is introduced to a CCD camera 11 via a mirror 10, and the sample observation image formed by the CCD camera 11 is displayed on the screen of a monitor 12. Between the sample plate 1 and the ion trap 20, an aperture 13 for shielding diffusing ions and an Einzel lens 14 as the ion transport optical system are placed. Various ion transport optical systems other than the Einzel lens 14 can be used. In particular, an electrostatic lens optical system can be used.

Outside the ion outlet 26 is placed the ion detector 30 which includes: a conversion dynode 31 for converting an injected ion into an electron; and a secondary electron multiplier 32 for multiplying and detecting the converted electrons. With this ion detector 30, both cations (positive ions) and anions (negative ions) can be detected. The detection signal by the ion detector 30 is provided to a data processing unit 44 in which the detection signal is converted into digital data and a data processing is performed on them.

A square wave voltage of a predetermined frequency is applied to the ring electrode 21 of the ion trap 20 from a capture voltage generator 42 (which corresponds to the voltage applier in the present invention), and a predetermined voltage (direct-current voltage or radio-frequency voltage) is applied to each of the pair of end cap electrodes 22 and 23 from an auxiliary voltage generator 43. In order to generate a square wave voltage as will be described later, the capture voltage generator 42 may include, for example: a positive voltage generator for generating a predetermined positive voltage; a negative voltage generator for generating a predetermined negative voltage; and a switching unit for rapidly switching the positive voltage and negative voltage to generate a square wave voltage. A control unit 40 (which corresponds to the controller in the present invention) controls the operation of the capture voltage generator 42, the auxiliary voltage generator 43, and the laser irradiator 3.

Figure 2:
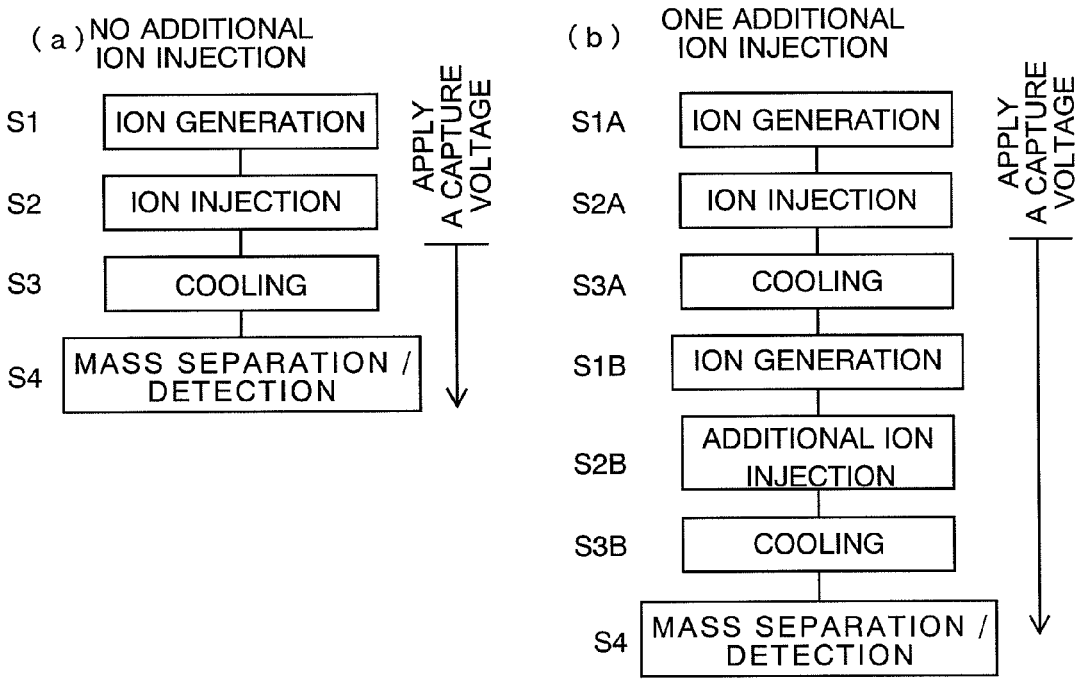
FIG. 2 is a flowchart illustrating the procedure of a series of processes performed for a mass analysis.

Next, the procedure of a mass analysis will be described, centering on the specific operation of the MALDI-DIT-MS according to the present embodiment. FIG. 2 is a flowchart illustrating the procedure of a series of processes (operations) performed for the mass analysis.

FIG. 2(*a*) shows a procedure of the mass analysis, as in the conventional case, where an additional ion injection is not performed. Under the control of the control unit 40, a shot of laser light is emitted for a short time from the laser irradiator 3 to be delivered to the sample 2. By this laser light irradiation, the matrix in the sample 2 is quickly heated and vaporized with the target component. In this process, the target component is ionized (Step S1). The generated ions pass through the aperture 13, are sent toward the ion trap 20 while being converged by the electrostatic field formed by the Einzel lens 14, and injected into the ion trap 20 through the ion inlet 25 (Step S2). Since the irradiation time of the laser light is very short, the generation time of ions is also short. Therefore, the generated ions reach the ion inlet 25 in a packeted form.

When ions are injected in the aforementioned case, the capture voltage is not applied to the ring electrode 21, the entrance-side end cap electrode 22 is maintained at zero voltage, and an appropriate direct-current voltage having the same polarity as the ion to be analyzed is applied to the exit-side end cap electrode 23. With this configuration, when ions that have entered the ion trap 20 come near to the ion outlet 26, they are repelled back to the capture region 24 by the electric field formed by the direct-current voltage applied to the exit-side end cap electrode 23.

Before ions are injected in the aforementioned case, a cooling gas such as helium is introduced to the ion trap 20 from the cooling gas supplier 29. As previously described, immediately after the ions are injected into the ion trap 20, the capture voltage generator 42 starts, under the control of the control unit 40, to apply a predetermined square wave voltage as a capture voltage to the ring electrode 21. Application of the square wave voltage forms, inside the ion trap 20, a capture electric field for capturing ions while oscillating them. Although the injected ions initially have a relatively large kinetic energy, they collide with the cooling gas existing in the ion trap 20, their kinetic energy is gradually lost (i.e., a cooling is performed), and they become more likely to be captured by the capture electric field (Step S3).

After the cooling for an appropriate period (approximately 100 [ms], for example) to stably capture the ions in the capture region 24, a radio-frequency signal of a predetermined frequency is applied to the end cap electrodes 22 and 23 by the auxiliary voltage generator 43, with the square wave voltage applied to the ring electrode 21, and thereby ions having a specific mass are resonantly excited. As the radio-frequency signal, the frequency-divided signal of the square wave voltage applied to the ring electrode 21 can be used, for example. The excited ions having the specific mass are expelled from the ion outlet 26, and injected into the ion detector 30 to be detected. In this manner, the mass separation and detection of ions are performed (Step S4).

The frequency of the square wave voltage applied to the ring electrode 21 and the frequency of the radio-frequency signal applied to the end cap electrodes 22 and 23 are appropriately scanned so that the mass of ions expelled from the ion trap 20 through the ion outlet 26 is scanned. By sequentially detecting them, a mass spectrum can be created in the data processing unit 44.

Since, in the aforementioned procedure, ions generated from the sample 2 by a single shot of laser light irradiation are captured in the capture region 24 of the ion trap 20, and mass separated and detected, the amount of target ions is not always sufficient and the signal intensity may be low. In such a case, the MALDI-DIT-MS according to the present embodiment can perform a mass analysis with the procedure as illustrated in FIG. 2(*b*).

Steps S1A through S3A are the same as Steps S1 through S3 described before, by which ions are captured in the capture region 24 in the ion trap 20. Next, with the ions captured in the capture region 24 of the ion trap 20, another shot of laser light is delivered again to the sample 2 to generate ions (Step S1B), and the generated ions are additionally injected into the ion trap 20 through the ion inlet 25 (Step S2B). Then, a cooling is performed for the additionally injected ions (Step S3B), and the ions stably captured in the capture region 24 after the two ion injections are mass separated and detected (Step S4).

Although FIG. 2(*b*) illustrates an example of performing an additional injection of ions only once, the additional injection of ions into the ion trap 20 can be performed any number of times, by repeatedly performing Steps S1 through S3B.

Next, a specific control performed when ions are additionally injected into the ion trap 20 will be described with reference to FIG. 3, which illustrates a waveform diagram and the operation of the relevant portion when an additional ion injection is performed. While a square wave voltage as a capture voltage having frequency f1 is applied to the ring electrode 21 and thereby target ions are stably captured in the capture region 24, the control unit 40 sends a laser drive pulse of short duration to the laser irradiator 3. In accordance with the drive pulse, the laser irradiator 3 emits a laser light only for a short period of time, and ions are generated from the sample 2. The time of the generation of the ions is so short that the ions can be regarded to be simultaneously generated. The generated ions are drawn upward from the vicinity of the sample plate 1, transported by the Einzel lens 14, and travel toward the ion inlet 25.

The control unit 40 controls the capture voltage generator 42 in such a manner as to change the frequency of the square wave voltage to f2 which is higher (e.g. four time higher) than f1 at the time point when just a predetermined delay time t1 has elapsed since it generated the laser drive pulse. At this time, the amplitude is maintained constant. The delay time t1 can be determined to be the value corresponding to the traveling time from when ions in a packeted form depart from the vicinity of the sample plate 1 until when they arrive at the ion inlet 25. This traveling time depends on the distance between the sample plate 1 and the ion inlet 25, the configuration of the Einzel lens 14, the voltage applied thereto, and other factors. In addition, since ions having smaller mass reach the ion inlet 25 sooner even if the ions have been generated exactly at the same time, the traveling time also depends on the mass of the ions to be analyzed. Considering these factors, it is preferable that the traveling time is previously obtained by a simulation computation or experiment, and is memorized in the controller 40, and the delay time t1 may be determined by using this traveling time. Preferably, the delay time t1 can be changed in accordance with the mass range of the ions to be analyzed.

Figure 3:
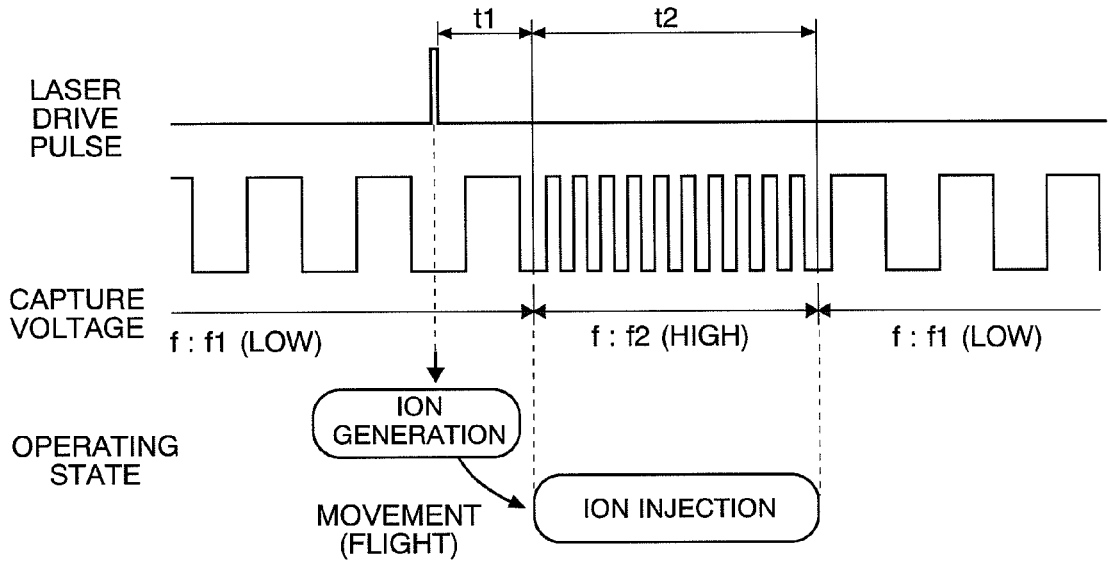
FIG. 3 illustrates a waveform diagram and the operation of the relevant portion when an additional ion injection is performed in the MALDI-DIT-MS according to the first embodiment.

The switching of the frequency of the square wave voltage is instantly performed as illustrated in FIG. 3. When the frequency of the square wave voltage is increased from f1 to 12, the pseudo-potential well in the capture region 24 becomes shallow as described before, and therefore the ions that reached the ion inlet 25 are not repelled but enter the ion trap 20. Since, on the other hand, the holding force for ions becomes weaker in the capture region 24 as described before, the ions start to disperse. But the period t2 in which the frequency is kept at f2 has been set shorter than the time period in which the ions disperse and disappear by colliding with the electrodes 21, 22, and 23, or escaping from the ion outlet 26 or other gaps. When the time t2 has elapsed, the control unit 40 controls the capture voltage generator 42 to quickly return the frequency to the original value f1. Accordingly, the ions that have started to disperse from the capture region 24 are drawn back by the electric field, and in addition, newly-entered ions are also captured in the capture region 24. Thus, the amount of ions increases than before.

As just described, in the MALDI-DIT-MS in the present embodiment, the amount of ions captured is increased by additionally injecting ions into the ion trap 20 one or more times, and then the mass separation and detection are performed. Therefore, the target ion can be detected with high signal intensity.

In the previous explanation, the Mathieu parameter $q_z$ was decreased by temporarily increasing the frequency of the square wave voltage. In place of this, the Mathieu parameter $q_z$ may be decreased by temporarily decreasing the amplitude of the square wave voltage.

The results of a simulation computation performed for verifying the ion capture efficiency of the MALDI-DIT-MS according to the aforementioned embodiment will be described.

Figure 6:
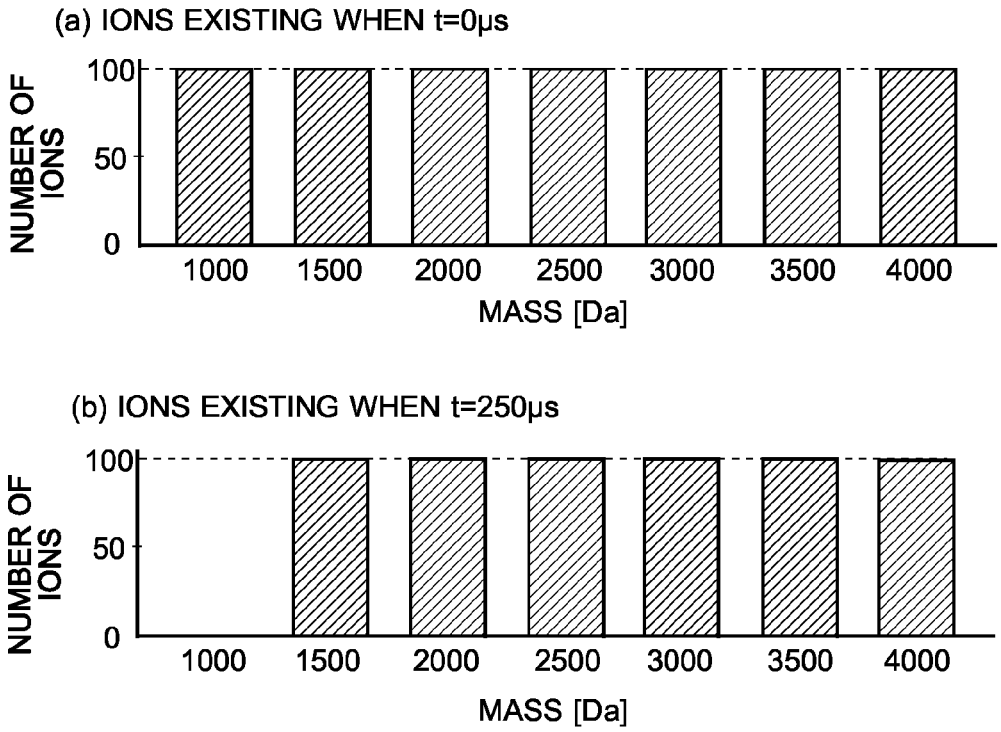
FIG. 6 is a diagram illustrating the results of a simulation for verifying the effect of an additional ion injection in the MALDI-DIT-MS of the first embodiment.

FIG. 6 illustrates the results of a simulation in the case where a symmetrical square wave voltage of V=±500[V] and f=250 [kHz] is applied to the ring electrode. The horizontal axis represents the mass of ions, and the vertical axis represents the number of ions. As illustrated in FIG. 6(*a*), it was supposed that a set of 100 ions were simultaneously (at t=0 [μs]) generated at every 500 [Da] in the range of 1000 through 4000 [Da] in the ion source.

FIG. 6(*b*) illustrates the result of a simulation calculating the number of ions remaining in the ion trap at the time point t=250 [μs], in the case where the frequency was set at 1 [MHz] at the time point (t=0) when the laser drive pulse was generated, and this frequency was held for 20 [μs] before it is changed to 250 [kHZ]. As other conditions, the voltage applied to the entrance-side end cap electrode 22 was set to be zero, the voltage applied to the exit-side end cap electrode 23 was first set at 10[V] at t=0 [μs], and then changed from 10[V] to 0[V], 10 [μs] after the frequency of the square wave voltage is changed. This result shows that the ions are captured with high efficiency of approximately 100%. That is, it is evident that the efficiency of an additional ion injection is high and the mass range of ions that can be additionally injected is large.

Figure 7:
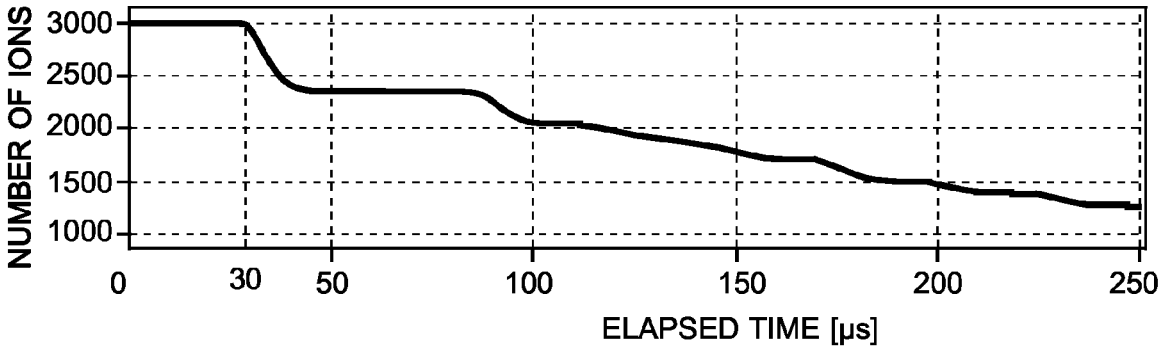
FIG. 7 is a diagram illustrating the results of a simulation for verifying the effect of an additional ion injection in the MALDI-DIT-MS of the first embodiment.

In the case where the Mathieu parameter $q_z$ is decreased, since the potential well of the capture region 24 becomes shallow, the ions that have entered with a high energy cannot be captured. In addition, since a voltage for decelerating ions is applied to the exit-side end cap electrode 23, the ions are attracted to the lower potential side. Considering these factors, a simulation was made for calculating the relationship between the time and the number of ions remaining in the ion trap 20 for 3000 ions having the mass of 1500 [Da], to which a cooling was performed by applying the square wave voltage of V=500[V] and f=500 [kHz] for 100 [ms], after the frequency of the square wave voltage was changed to 1 [MHz] and a voltage of 10[V] was applied to the end cap electrode 23. FIG. 7 illustrates the result of this simulation.

This result shows that all ions remain in the ion trap 20 until 30 [μs], and although the number of ions gradually decreases after that, approximately half the ions remain in the ion trap 20 before 200 [μs]. Therefore, if the duration of the period in which the frequency is temporarily increased is less than 30 [μs], almost all the ions that have been previously captured can be held. On the other hand, the time required for an ion that has reached the ion inlet 25 to enter the ion trap 20 through the ion inlet 25 to be captured is at most 20 [μs]. Hence, also the simulation confirmed that if the time in which the Mathieu parameter $q_z$ is decreased by temporarily increasing the frequency is set to be approximately 20 to 30 [μs], the ions newly generated can be efficiently taken in the ion trap 20 to increase the amount of ions with little decrease in the number of already captured ions.

Adding ions to the ion trap 20 as previously described can be performed not only once but can be repeated two and more times, and the amount of ions can be increased in accordance with the number of repetitions. The result of an experiment for verifying the effect according to the number of additional ion injections will be explained with reference to FIG. 8.

The sample was Angiotensin II (m/z: 1046), and the matrix was α-cyano-4-hydroxycinnamic acid (CHCA). First, in injecting ions into the ion trap 20 for the first time, the capture voltage is not applied to the ring electrode 21. Immediately after the ions generated from the sample 2 by a laser light irradiation are injected into the ion trap 20, a direct-current voltage having the same polarity as the ions is applied to the end cap electrodes 22 and 23 to trap the ions. A little later, a capture voltage (square wave voltage) is started to be applied to the ring electrode 21 to make the ions trapped in the ion trap 20 move on a stable orbit.

In additionally injecting ions into the ion trap 20, the frequency of the square wave voltage is increased at the moment when ions generated from the sample 2 by a laser light irradiation reaches the ion inlet 25, and after approximately 20 [μs], the frequency is returned to the original value. The additionally injected ions are sufficiently cooled by being made to collide with the cooling gas, and stably captured in the capture region 24.

Figure 8:
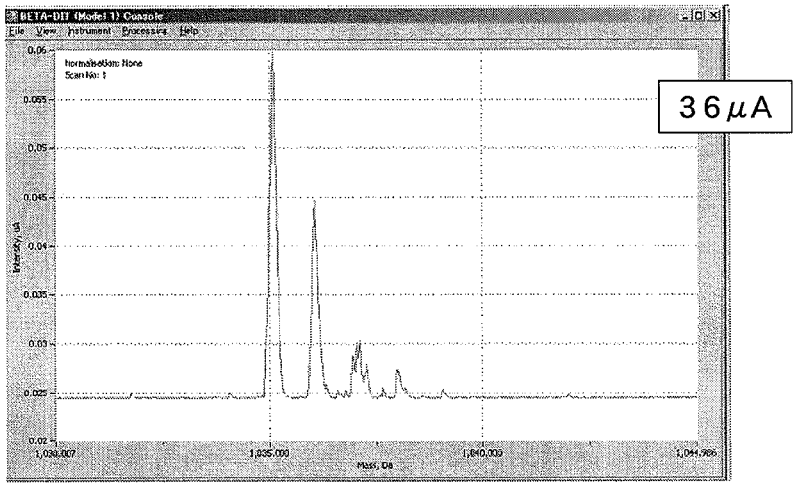
FIG. 8 is a diagram illustrating the results of a simulation for verifying the effect of an additional ion injection in the MALDI-DIT-MS of the first embodiment.
Figure 8:
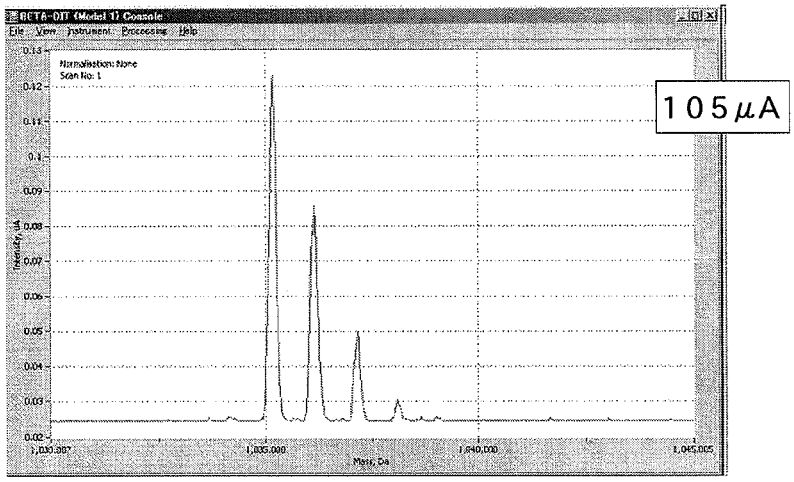
Figure 8:
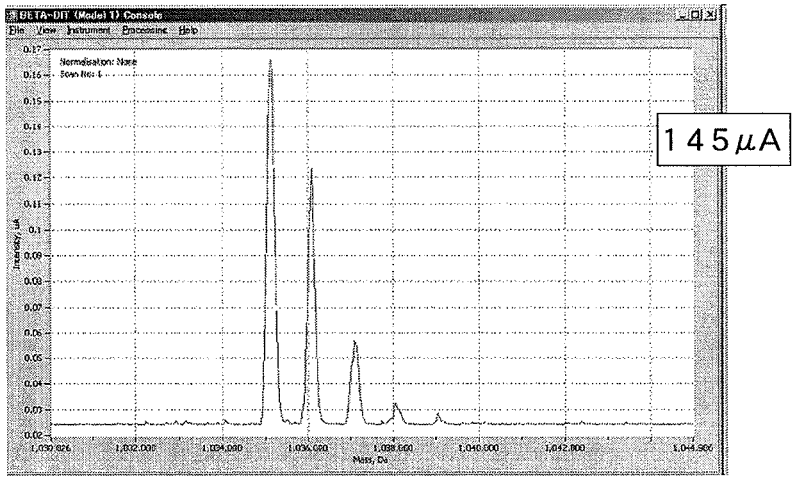

In the present experiment, the following three sequences are prepared: no additional ion is injected (i.e. ions are injection only once) into the ion trap 20; ions are additionally injected once; and ions are additionally injected twice. Each of the above three sequences was repeated ten times, so that the mass profiles detected each time were summed up for ten times to create an ultimate mass spectrum. The results are shown in FIG. 8, in which the signal intensities of the peak of the mass are numerically shown. It was experimentally confirmed that the increase in the number of additional ion injections increases the signal intensity and improves the S/N.

Further, by additionally injecting ions into the ion trap 20 as previously described, the signal intensity can be increased while suppressing the elongation of the measuring time. That is, although the operation composed of ion generation, ion injection, and then cooling is required for performing an additional ion injection as illustrated in FIG. 2, this series of operations is short compared to the time required for the subsequently performed mass analysis. Due to this, in the experiment that the inventors of the present patent application have carried out, the measuring times for the no additional ion injection, one additional ion injection; and two additional ion injections were respectively 11.1, 12.2, and 13.3 seconds. This shows that the significant effect of signal intensity increase as previously described can be achieved with a little increase in the measuring time.

Second Embodiment

Next, as another embodiment (the second embodiment) of the present invention, a MALDI-DIT-MS, in which the function of the additional ion injection into the ion trap as previously described is used for a mass calibration, will be described. Generally, in order to obtain data with high mass accuracy in a mass spectrometer, it is inevitable to perform a mass calibration using a standard sample whose mass-to-charge ratio is known. A mass calibration in a conventional MALDI-IT-MS is performed in the same manner as an apparatus without an ion trap such as a MALDI-TOFMS. Generally, there are two methods for performing a mass calibration in a MALDI-TOFMS: the external standard method and the internal standard method.

In performing a mass calibration by the external standard method, before a measurement of an analysis sample (analyte), an analysis operator applies a calibration sample (calibrant) including a compound whose mass-to-charge ratio is known at a different position on a sample plate from the analysis sample. Next, the measurement of the calibration sample is first performed, then the mass calibration of the apparatus is performed using this measurement result, and after that, the measurement of the analysis sample is performed. Alternatively, the measurement of the calibration sample may be performed after the measurement of the analysis sample, and after all the measurements, the mass calibration formula may be derived using the data obtained by the measurement of the calibration sample, and the mass calibration of the mass analysis data of the analysis sample may be performed as a post process using the formula. In addition, for the purpose of higher accuracy, a measurement of the calibration sample may be performed each time before and after the measurement of the analysis sample, and the mass calibration may be performed using the data obtained thereby. Such a series of measurements and computational processing for mass calibration is often performed on dedicated software supplied with the apparatus.

In performing a mass calibration by the internal standard method, an analysis operator prepares a sample in which the calibration sample is previously mixed to the analysis sample. Then, the measurement of the mixed sample is performed, and the mass calibration of the data is performed using the peak originating from the calibration sample on the obtained data (mass spectrum), and after the calibration, the mass of the peak originating from the analysis sample is read.

In terms of performing a calibration with high mass accuracy, the internal standard method is generally preferable to the external standard method. In order to perform the internal standard method, on the mass spectrum obtained by measuring the mixed sample, all the peaks originating from each sample must be included with sufficient intensity and resolution. In practice, however, the "ionization competition" frequently occurs in which ions of one sample become difficult to be generated when ions of the other sample are generated in large numbers, and therefore it is often difficult to obtain the appropriate mass spectrum as previously described. In order to prevent this happens, it is preferable to optimize the mixing ratio of the analysis sample and the calibration sample. However, since the optimal mixing ratio varies with the kinds of samples to be analyzed, such an optimization operation takes a lot of time. Hence, this method is impractical if the number of samples is large and high throughput is required.

If the optimum solvent and optimum matrix are different between the analysis sample and the calibration sample, preparation of the mixed sample is difficult by itself and the internal standard method cannot be employed. Consequently, the external standard method must be used, which decreases the accuracy of mass calibration.

In an MS/MS analysis or an $MS^n$ analysis using the MALDI-IT-MS, ions other than precursor ions are ejected from the ion trap in the course of selecting the precursor ions. Hence, the internal standard method cannot be employed. Therefore, the external standard method must be used also in this case, which decreases the accuracy of mass calibration.

Figure 9:
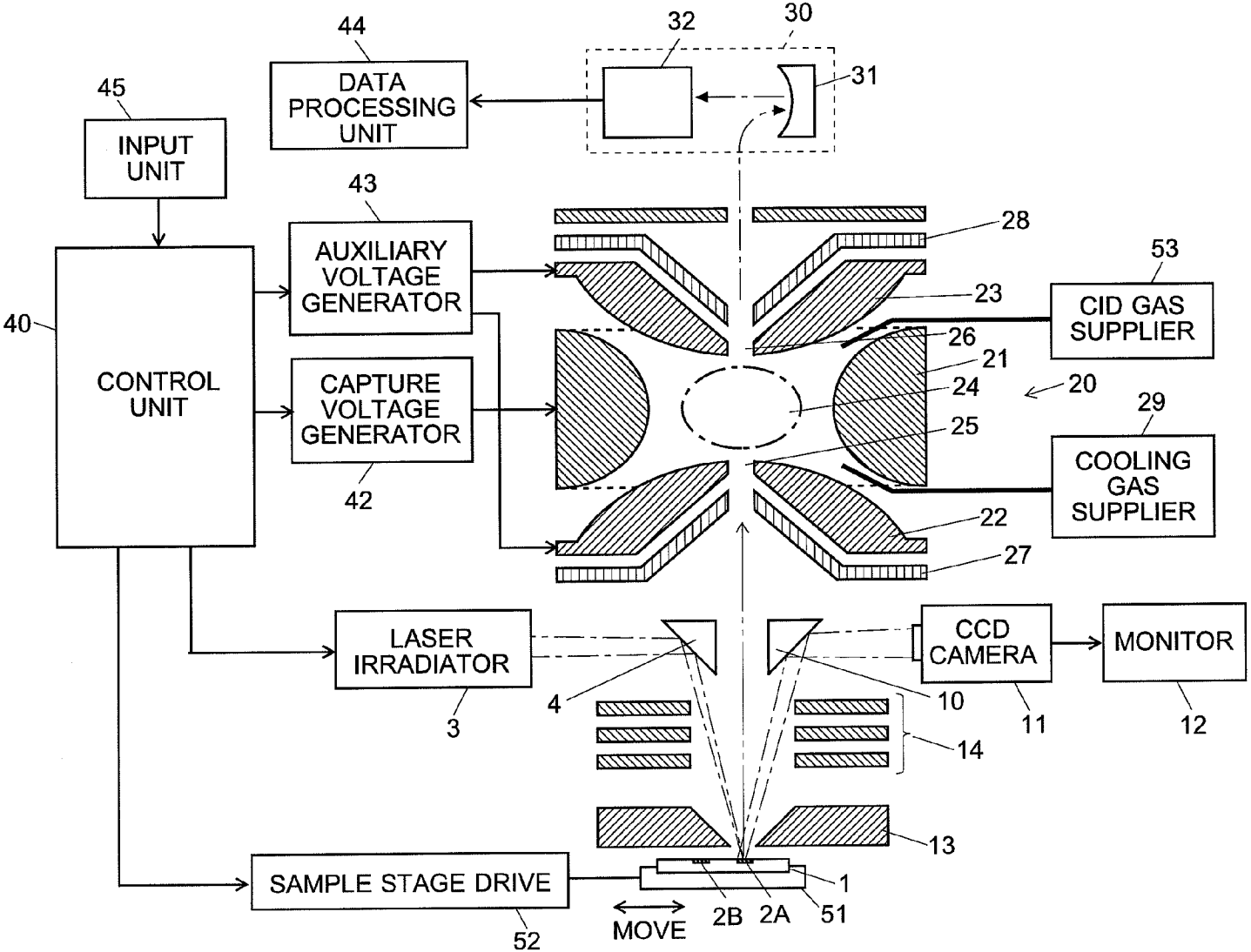
FIG. 9 is an entire configuration diagram of the MALDI-DIT-MS according to the second embodiment of the present invention.
Figure 10:
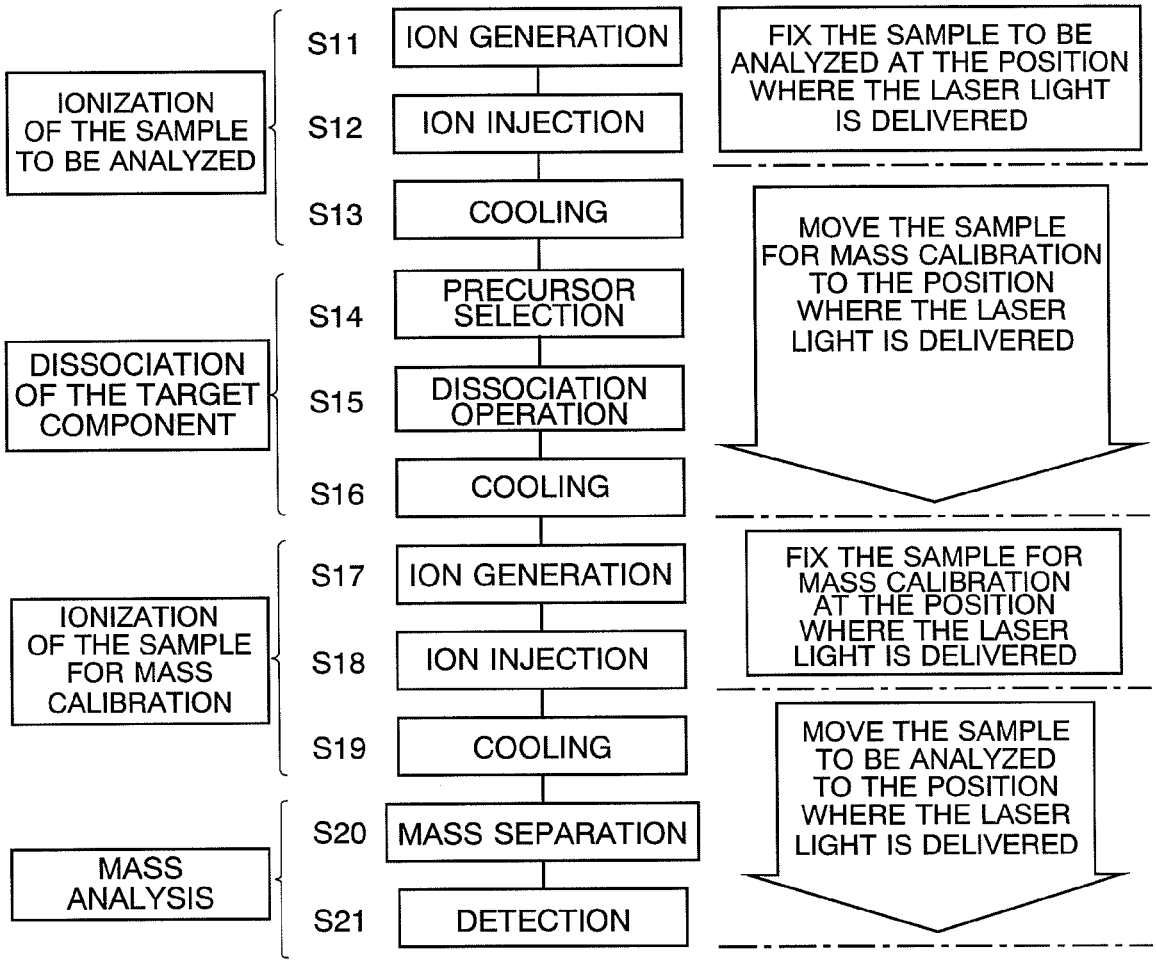
FIG. 10 is a flowchart illustrating the procedure of a typical mass analysis process performed in the MALDI-DIT-MS according to the second embodiment.

For these problems, by using the technique of the additional ion injection as previously described, it is possible to realize a mass calibration in accordance with the internal standard method without preparing a mixture of the analysis sample and the calibration sample. FIG. 9 is an entire configuration diagram of the MALDI-DIT-MS according to this second embodiment, and FIG. 10 is a flowchart illustrating the procedure of a typical mass analysis process performed in the MALDI-DIT-MS according to the second embodiment. In FIG. 9, the same components as the MALDI-DIT-MS in the first embodiment as illustrated in FIG. 1 are indicated with the same numerals and the explanations are omitted.

In the MALDI-DIT-MS of the second embodiment, an analysis sample 2A and a calibration sample 2B are prepared at different positions on the sample plate 1. A sample stage 51 for holding the sample plate 1 is movable by a sample stage drive 52 including a drive source such as a motor, and thereby the analysis sample 2A and the calibration sample 2B are selectively brought to the position where a laser light is delivered. Since the analysis sample 2A and the calibration sample 2B can be independently prepared, a suitable solvent and matrix can be chosen for each of them, and the preparation can be performed in exactly the same manner as in the case of the mass calibration by the external standard method. A CID gas supplier 53 is for introducing a CID gas such as argon in order to dissociate ions by the collision induced dissociation (CID) in the ion trap 20.

When an analysis is started, the control unit 40 locates, by the sample stage drive 52, the analysis sample 2A at the position where a laser is delivered, and a laser light is shot for a short time from the laser irradiator 3 to the analysis sample 2A. This ionizes the target component in the analysis sample 2A (Step S11). Immediately before the irradiation of the laser light, a cooling gas is introduced inside the ion trap 20 from the cooling gas supplier 29. The ions generated with the irradiation of the laser light are injected into the ion trap 20 through the aperture 13, Einzel lens 14, and via the ion inlet 25 (Step S12). While these ions are injected, a capture voltage is not applied to the ring electrode 21. An appropriate direct-current voltage having the opposite polarity to the ions to be analyzed is applied to the entrance-side end cap electrode 22 and an appropriate direct-current voltage having the same polarity as the ions to be analyzed is applied to the exit-side end cap electrode 23.

Immediately after the ions are injected into the ion trap 20, the auxiliary voltage generator 43 applies a direct-current voltage having the same polarity as the ions to be analyzed to the entrance-side end cap electrode 22 to trap the injected ions in the ion trap 20. Slightly after this, the auxiliary voltage generator 42 starts to apply a predetermined square wave voltage as the capture voltage to the ring electrode 21. This makes the ions trapped in the ion trap 20 move on the stable orbit by the capture electric field. The captured ions lose their kinetic energy by colliding with the cooling gas which has been previously introduced to the ion trap 20, their orbit becomes smaller, and they are assuredly captured (Step S13).

Next, in order to selectively leave the ions having a specific mass-to-charge ratio as the precursor ion among a variety of ions originating from the analysis sample 2A captured in the ion trap 20, the other ions are expelled from the ion trap 20 (Step S14). In order to perform such a selection, a conventionally-known method, such as the method described in U.S. Pat. No. 6,900,433, the method described in Japanese Unexamined Patent Application Publication No. 2003-16991, or other method can be used.

To give an example, when radio-frequency voltages having opposite polarities are applied to the pair of end cap electrodes 22 and 23, ions having the natural frequency (eigenfrequency) corresponding to the frequency of the radio-frequency voltage resonate and oscillate. The amplitude of their resonant vibration gradually increases, and soon the ions fly out from the ion trap 20 or collide with the inner surface of the electrode to be eliminated. The mass of a resonant-oscillating ion has a predetermined relationship with the natural frequency. Therefore, in order to eliminate unnecessary ions having a predetermined mass, it is only necessary to apply a radio-frequency voltage having a frequency in correspondence to the mass of the ions to the end cap electrodes 22 and 23.

Alternatively, a wideband AC voltage having a frequency spectrum that has a notch at the frequency corresponding to the mass of the ions to be left may be applied to the end cap electrodes 22 and 23. Then, only the ions having the mass-to-charge ratio corresponding to the notch frequency do not resonantly oscillate and remain in the ion trap 20, and the other ions are eliminated from the ion trap 20. Such a wideband voltage having a notch as previously described can be generated by the methods such as: synthesizing a large number of sinusoidal voltages having different frequencies, and forming a notch in a white noise.

After selecting the precursor ions, a collision-induced dissociation (CID) gas such as argon is provided to the ion trap 20 from the CID gas supplier 53 in order to dissociate the precursor ions left in the ion trap 20, and immediately after this, the auxiliary voltage generator 43 applies an excitation voltage, to the end cap electrodes 22 and 23, of a frequency which is the same as the secular frequency determined by the mass of the precursor ion. This oscillates the precursor ions and they are dissociated by colliding with the CID gas to generate a variety of product ions (Step S15).

After the dissociation operation, in order to shrink and stabilize the orbit of the generated product ions, a cooling gas is introduced to the ion trap 20 from the cooling gas supplier 29 to cool the product ions (Step S16).

When the ion generation and injection by the laser light irradiation are finished, the control unit 40 moves the sample stage 51 to locate the calibration sample 2B at the position where the laser is delivered. At the latest, by the time point when the cooling of Step S16 finishes, the calibration sample 2B is set at the position where the laser is delivered.

After the cooling, the control unit 40 let a laser light emitted from the laser irradiator 3 for a short period of time, as in the case of the previously-described ionization of the analysis sample 2A, to deliver it to the calibration sample 2B. This ionizes the component in the calibration sample 2B (Step S17). Immediately before the irradiation of the laser light, a cooling gas is introduced inside the ion trap by the cooling gas supplier 29. In addition, the control unit 40 controls the capture voltage generator 42, as in the case of the additional injection of ions in the first embodiment, in such a manner that the frequency of the square wave voltage is increased only for a short time (e.g. approximately 20 to 30 [μs]) at the time point when a predetermined delay time has elapsed since it generated a laser drive pulse. Then, the frequency of the capture voltage is increased at the right timing when ions in a packeted form generated in accordance with the irradiation of the laser light are about to be injected into the ion trap 20 through the aperture 13, the Einzel lens 14, and via the ion inlet 25. Accordingly, while suppressing the loss of the ions (mainly product ions generated by dissociation) originating from the analysis sample 2A already held in the ion trap 20, the ions originating from the calibration sample 2B can be newly and efficiently injected into and held in the ion trap 20 (Step S18).

After that, in order to shrink and stabilize the orbit of the ions originating from the calibration sample 2B, a cooling gas is introduced to the ion trap 20 from the cooling gas supplier 29 to cool the additionally injected ions (Step S19). As a result, in the ion trap 20, a variety of product ions generated from the precursor ion having a specific mass-to-charge ratio among ions originating from the analysis sample 2A, and ions originating from the calibration sample 2B are stably held in a mixed state.

After the cooling for an appropriate time, as in Step S4 in the first embodiment, the frequency of the square wave voltage applied to the ring electrode 21 and the frequency of the radio-frequency signal applied to the end cap electrodes 22 and 23 are appropriately scanned so that the masses of ions to be resonantly-excited are scanned. The ions ejected with this scanning from the ion trap 20 are sequentially detected in the ion detector 30 (Steps S20 and S21). Accordingly, a mass spectrum of a predetermined mass range can be created in the data processing unit 44. On the mass spectrum, the peaks of the product ions and other ions originating from the analysis sample 2A and the peaks of the ions originating from the calibration sample 2B appear. Since the mass of the ions originating from the calibration sample 2B is known, the data processing unit 44 extracts the peaks originating from the calibration sample 2B among the peaks appearing on the mass spectrum and performs a mass calibration using the ion peaks. After the calibration, the mass of the peaks of a variety of ions to be targeted is read and processed, e.g. identified.

That is, ions originating from the analysis sample 2A and ions originating from the calibration sample 2B that are mixed in the ion trap 20 are simultaneously measured, then a mass calibration is performed using the result of the latter measurement, and the result of the former measurement is accurately obtained. In this respect, this is a mass calibration itself by the internal standard method, and a high mass accuracy can be achieved. On the other hand, the analysis sample 2A and the calibration sample 2B are not required to be mixed beforehand, and each of them can be individually prepared using a different solvent and different matrix (the same solvent and matrix may be used, of course). In this respect alone, the same simplicity as the external standard method is achieved. In other words, it can be said that the mass calibration realized with this apparatus according to the second embodiment combines the high mass accuracy by the internal standard method and the easiness of the sample preparations in the external standard method.

In the aforementioned explanation, the analysis sample 2A and the calibration sample 2B are each ionized once and injected into the ion trap 20. However, ions originating from each sample may be additionally injected into the ion trap 20 to increase the amount of the ions to be mass analyzed.

In the case where ions originating from the analysis sample 2A are needed to be directly observed, the operations of Steps S14 through S16 in the flowchart illustrated in FIG. 10 may be omitted. In this case, the procedures may be interchanged in such a manner that the ionization and ion injection of the calibration sample 2B may be performed first, and then the ionization and ion injection of the analysis sample 2A may be performed. Alternatively, the precursor selection and dissociation process may be repeated plural times rather than performing only once the dissociation of the ions originating from the analysis sample 2A.

The operation of selectively leaving ions having a specific mass-to-charge ratio among the ions originating from the analysis sample 2A (which is the same operation as the precursor selection of Step S14) may be performed. Subsequently, without dissociating them, the ionization of the calibration sample 2B and additional ion injection may be performed.

Generally, since the efficiency of ion generation differs depending on the kind of sample, it is preferable that the intensity of the laser light irradiated for the ionization of the analysis sample 2A and the intensity of the laser light irradiated for the ionization of the calibration sample 2B may be independently set. The optimum laser light intensity can be determined by a preliminary experiment using actual samples.

An example of the actual measurement of an MS/MS analysis using the MALDI-DIT-MS of the second embodiment will be described. A tryptic digest of bovine serum albumin was used as an analysis sample, and polyethylene glycol (PEG) as a calibration sample. PEG has a property suitable for a calibration sample in that a number of peaks appear at 44 [Da] intervals across a broad mass range. The matrix was CHCA for all the samples.

Figure 11:
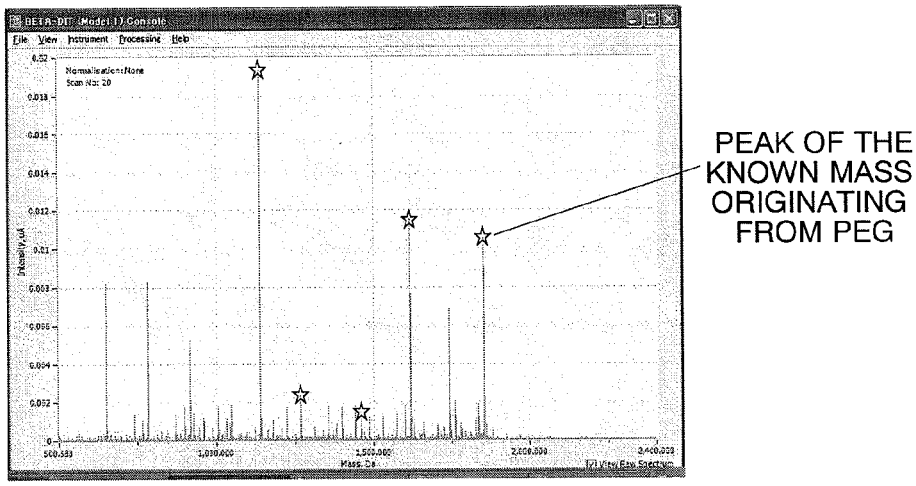
FIG. 11 illustrates the mass spectrums obtained by an actual measurement.
Figure 11:
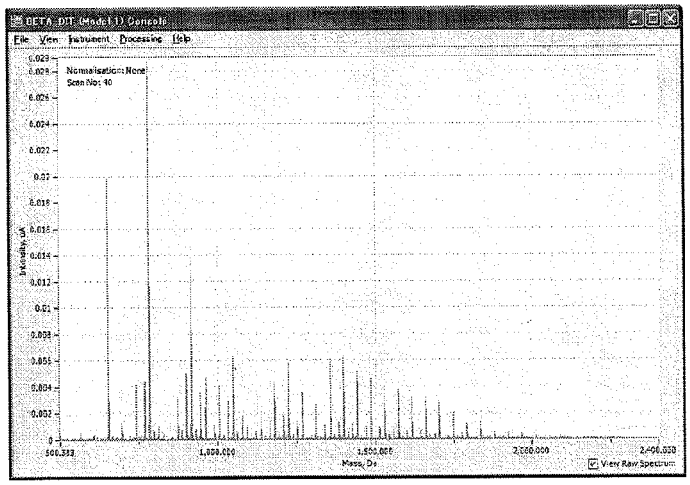
Figure 11:
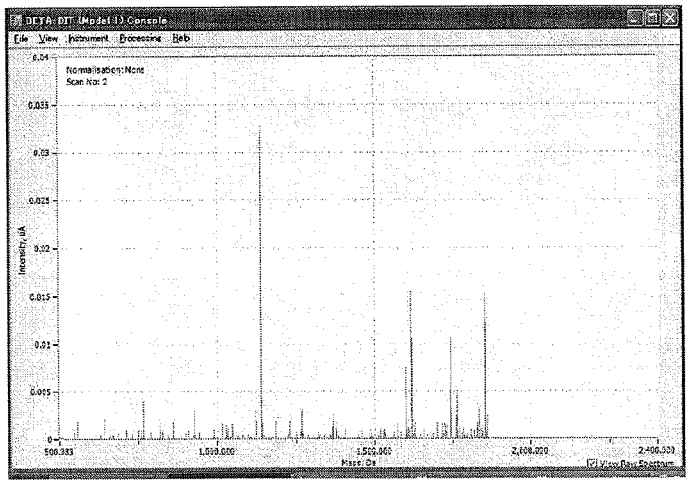

FIG. 11(*a*) is a mass spectrum obtained by the procedure that was explained for FIG. 10 (the precursor ion of m/z=1880), and the stars in the figure indicate the ion peaks originating from the PEG whose mass is known. The others are the ion (mainly product ion) peaks originating from the analysis sample. For comparison, FIGS. 11(*b*) and (*c*) respectively illustrate a mass spectrum obtained by independently analyzing PEG and the analysis sample (tryptic digest of bovine serum albumin).

Figure 12:
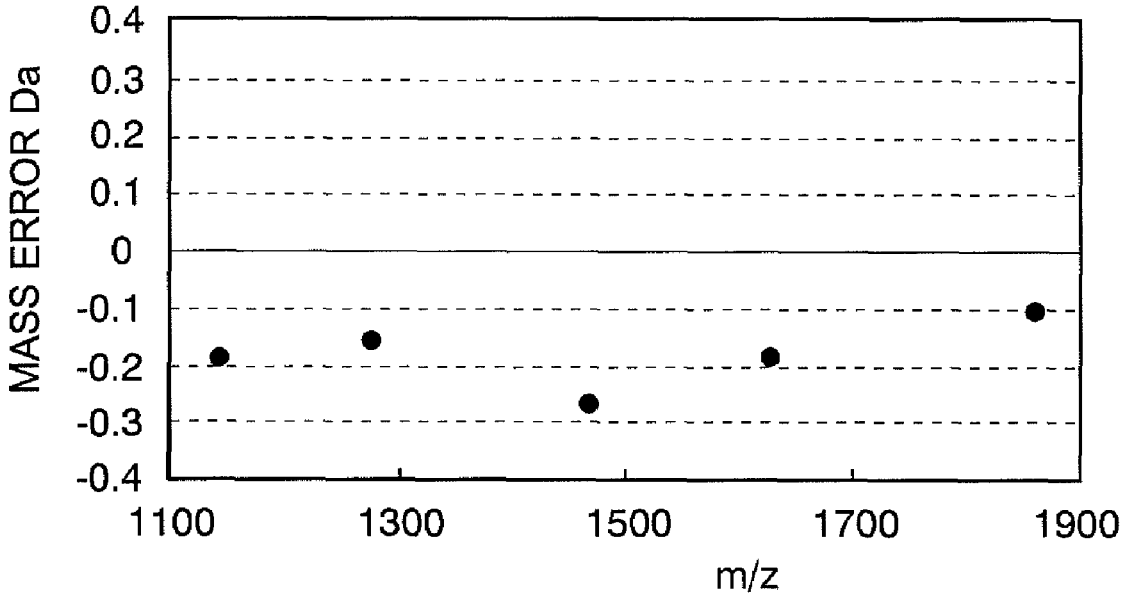
FIG. 12 illustrates the computational results of the mass error after a mass calibration based on actual measurement data.
Figure 12:
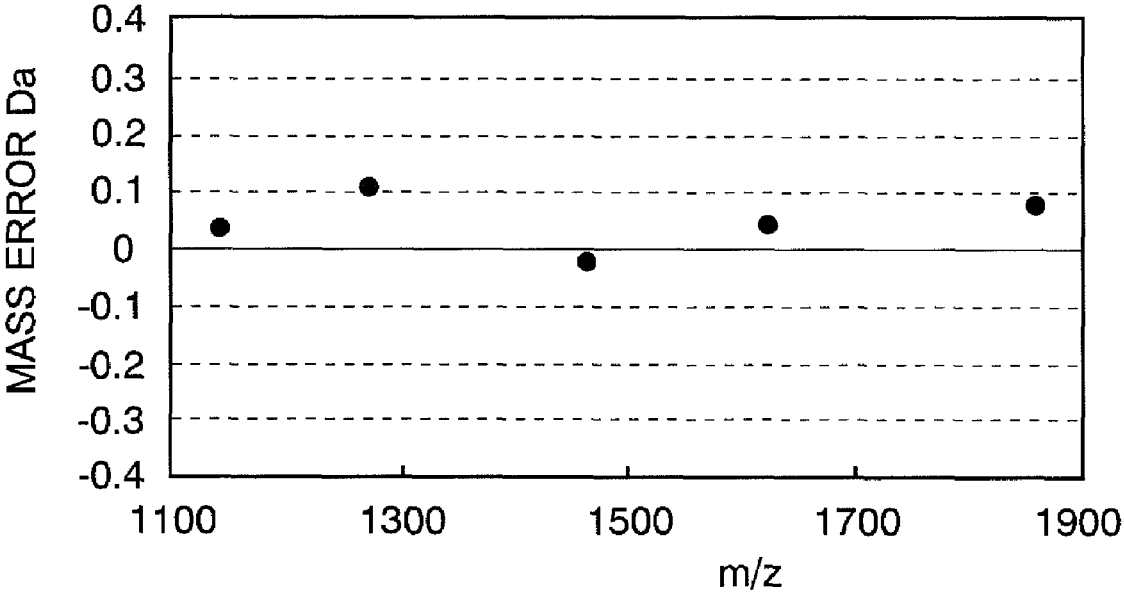

FIG. 12(*a*) illustrates the result of a computation of mass errors, in the case where a mass correction of the ions originating from the analysis sample appearing in FIG. 11(*a*) is performed by the external standard method using the mass spectrum data of the PEG illustrated in FIG. 11(*b*). As is understood from FIG. 12(*a*), although the variation itself of the mass errors is small, they are overall shifted approximately by −0.2 [Da]. Meanwhile, FIG. 12(*b*) illustrates the result of a computation of mass errors, in the case where a mass correction of the ions originating from the analysis sample appearing in FIG. 11(*a*) is performed by the internal standard method using the ion peaks originating from the PEG appearing also in FIG. 11(*a*). In this case, the mass errors fall within the range of ±0.1 [Da], and the phenomenon of the shift of approximately −0.2 [Da] as in the external standard method is not shown. This confirms that a highly accurate mass calibration is possible.

It should be noted that the embodiments described thus far are merely an example of the present invention, and it is evident that any modification, addition, or adjustment made within the sprit of the present invention is also covered by the present patent application.

The invention claimed is:

1. An ion trap mass spectrometer having an ion source for supplying pulsed ions and an ion trap for capturing the ions by an electric field formed in a space surrounded by a plurality of electrodes, wherein ions supplied from the ion source are injected into and captured in the ion trap, and a mass analysis is performed in the ion trap or after the ions are ejected from the ion trap, the ion trap mass spectrometer comprising:

a) a voltage applier for applying an AC voltage for capturing ions in the ion trap to at least one of the plurality of electrodes which compose the ion trap; and b) a controller for controlling the voltage applier in such a manner as to, while the AC voltage is applied to one of the plurality of electrodes to capture ions in the ion trap, temporarily increase a frequency of the AC voltage with an amplitude thereof kept constant or temporarily decrease an amplitude of the AC voltage with a frequency thereof kept constant when ions supplied in a pulsed fashion from the ion source reaches an ion inlet of the ion trap, in order that, while the ions are captured in the ion trap, ions supplied from the ion source are additionally injected into the ion trap.

2. The ion trap mass spectrometer according to claim 1, wherein the AC voltage is a square wave voltage.

3. The ion trap mass spectrometer according to claim 1, wherein the ion trap is a three-dimensional quadrupole ion trap having a ring electrode and a pair of end cap electrodes.

4. The ion trap mass spectrometer according to claim 3, wherein the ion source is a laser ion source for delivering a pulsed laser light to a sample to ionize the sample or a component in the sample.

5. The ion trap mass spectrometer according to claim 4, wherein the ion source is a matrix assisted laser desorption ionization source.

6. The ion trap mass spectrometer according to claim 5, further comprising an ion transport means of an electrostatic lens for transporting an ion supplied from the ion source to the ion trap.

7. The ion trap mass spectrometer according to claim 6, wherein the electrostatic lens is an Einzel lens (or unipotential lens).

8. The ion trap mass spectrometer according to claim 1, wherein ions are captured in the ion trap, then a frequency or an amplitude of the AC voltage is changed to selectively eject ions having a specific mass-to-charge ratio from the ion trap, and the ejected ions are detected by a detector.

9. The ion trap mass spectrometer according to claim 1, wherein ions are captured in the ion trap, then the captured ions are collectively ejected from the ion trap, and the ejected ions are introduced to a mass analyzer to be mass analyzed and then detected by a detector.

10. The ion trap mass spectrometer according to claim 1, wherein the ion source selectively supplies ions originating from an analysis sample and ions originating from a calibration sample, and the ion trap mass spectrometer further comprises:

an analysis controller for supplying either one of ions originating from the analysis sample and ions originating from the calibration sample from the ion source, and, while the ions are captured in the ion trap, for supplying other one of the ions originating from the analysis sample and the ions originating from the calibration sample from the ion source and additionally injecting the ions into the ion trap, and then mass analyzing mixture of the ions originating from the analysis sample and the ions originating from the calibration sample in the ion trap or after ejecting the mixture of the ions from the ion trap; and a data processor for performing a mass calibration by using data of the ion originating from the calibration sample in mass spectrum data obtained under a control of the analysis controller.

11. The ion trap mass spectrometer according to claim 10, wherein the ion source includes:

a sample plate for holding the analysis sample and the calibration sample in different positions;

a laser light irradiator for delivering a pulsed laser light to a sample to ionize a component in the sample; and a moving means for moving the sample plate in such a manner as to selectively position the analysis sample and the calibration sample at a position where the laser light is delivered by the laser light irradiator.

12. The ion trap mass spectrometer according to claim 11, wherein the ion source is a matrix assisted laser desorption ionization source.

13. The ion trap mass spectrometer according to claim 12, wherein the laser light irradiator changes an intensity of the laser light between a case for ionizing the analysis sample and a case for ionizing the calibration sample.

14. The ion trap mass spectrometer according to claim 12, further comprising:

an ion selector for applying a voltage to at least one of the plurality of electrodes which compose the ion trap in such a manner as to leave ions having a specific mass and remove other ions from the ion trap among ions captured in the ion trap; and a dissociation promoter for promoting a dissociation of ions captured in the ion trap, wherein:

the ions originating from the analysis sample are first captured in the ion trap, and the ions having the specific mass is left in the ion trap by the ion selector, then a dissociation of the left ions is promoted by the dissociation promoter, and after that, the ions originating from the calibration sample are additionally injected into the ion trap.

15. The ion trap mass spectrometer according to claim 12, further comprising an ion selector for applying a voltage to at least one of the plurality of electrodes which compose the ion trap in such a manner as to leave ions having a specific mass and remove other ions from the ion trap among ions captured in the ion trap, wherein:

the ions originating from the analysis sample are first captured in the ion trap, and the ions having the specific mass is left in the ion trap by the ion selector, and then the ions originating from the calibration sample are additionally injected into the ion trap.

* * * * *